US007330403B2

(12) United States Patent
Goeller

(10) Patent No.: US 7,330,403 B2
(45) Date of Patent: Feb. 12, 2008

(54) TIMEPIECE INCLUDING A STRIKING MECHANISM WITH A SINGLE CLICK

(75) Inventor: Eric Goeller, Les Hôpitaux Vieux (FR)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 11/610,581

(22) Filed: Dec. 14, 2006

(65) Prior Publication Data

US 2007/0147183 A1 Jun. 28, 2007

(30) Foreign Application Priority Data

Dec. 14, 2005 (EP) ..... 05112169

(51) Int. Cl.
*G04B 21/02* (2006.01)
*G04B 25/00* (2006.01)

(52) U.S. Cl. ..... 368/75; 368/267; 368/269

(58) Field of Classification Search ..... 368/72–75, 368/243, 244, 259, 260, 267–271
See application file for complete search history.

(56) References Cited

U.S. PATENT DOCUMENTS 2,054,765 A * 9/1936 Campbell ..... 368/269
3,475,900 A * 11/1969 Wingler ..... 368/263
3,520,126 A * 7/1970 Kolodziej ..... 368/75
3,702,529 A * 11/1972 Zeter et al. ..... 368/270
4,036,004 A * 7/1977 Jauch ..... 368/269
4,036,005 A * 7/1977 Jauch ..... 368/269
4,358,838 A * 11/1982 Nakamura ..... 368/75

FOREIGN PATENT DOCUMENTS

| | | |
|---|---|---|
| CH | 16112 | 2/1898 |
| CH | 16593 | 4/1898 |
| CH | 689 337 A5 | 2/1999 |
| EP | 1 429 214 A1 | 6/2004 |

OTHER PUBLICATIONS

European Search Report issued in corresponding application No. EP 05 11 2169, completed Nov. 8, 2006.
Lecoultre, François, "Les Montres Compliquées," Éditions Horlogères, Imprimerie Charles Rohr, Bienne, Switzerland, pp. 97-205, 1985.

* cited by examiner

*Primary Examiner*—Vit W Miska
(74) *Attorney, Agent, or Firm*—Griffin & Szipl, P.C.

(57) ABSTRACT

The invention proposes a timepiece comprising a repeater striking mechanism (14), the striking mechanism being released either automatically, or manually by a manual control member (22), wherein the striking mechanism (14) includes a release lever (24) fitted with a click (26) which meshes with the teeth of a ratchet detent wheel (28) such that, during automatic release, a release cam causes the release lever (24) to pivot towards the detent wheel (28), characterized in that the release lever (24) is fitted with a toggle lever (104) which carries the click (26) and which is pivotably connected to the release lever (24) during automatic release, and in that manual release is caused by the pivoting of the toggle lever (104) relative to the release lever (24) via the action of the manual control member (22).

8 Claims, 4 Drawing Sheets

TIMEPIECE INCLUDING A STRIKING MECHANISM WITH A SINGLE CLICK

This application claims priority from European Patent Application No. 05112169.7, filed Dec. 14, 2005, the entire disclosure of which is incorporated herein by reference.

FIELD OF THE INVENTION

The invention concerns a timepiece comprising a striking mechanism.

The invention concerns more specifically a timepiece comprising a timepiece movement and a repeater striking mechanism, the striking mechanism being either automatically released by the timepiece movement, or manually by a manual control member, wherein the striking mechanism comprises a release lever fitted with a click which is pivotably mounted on the release lever and which meshes with the teeth of a ratchet detent wheel such that, during automatic release, a release cam driven by the motion work of the timepiece movement causes the release lever to pivot towards the detent wheel and the click drives the detent wheel in rotation.

BACKGROUND OF THE INVENTION

Such timepieces have been known for a long time, in particular within the field of complicated watches, such as repeater watches or grand strike watches. For better comprehension of the state of the art in the field of complicated watches, reference can be made to the work of François Lecoultre entitled, "Les montres compliquées" (ISBN 2-88175-000-1), which comprises in particular several chapters relating to watches fitted with a striking mechanism (pages 97 to 205).

Among watches with a striking mechanism, the grand strike watch comprises an automatic release mode and a manual release mode for the striking mechanism. For automatic release, the motion work drives in rotation a release cam in the form of a star with four arms that cooperates with the release lever so as to wind it and release it in succession, at a determined moment, which releases the striking mechanism via the click. For manual release, an additional click is provided, which meshes with the detent wheel, when it is activated by a manual control member, so as to release the striking mechanism.

It is an object of the present invention to simplify the striking mechanism by omitting the click used for manual release.

SUMMARY OF THE INVENTION

The invention therefore proposes a timepiece of the type previously described, characterized in that the release lever is fitted with a toggle lever that carries the click, and in that the toggle lever is pivotably connected to the release lever during automatic release, and in that the manual release is caused by the pivoting of the toggle lever relative to the release lever via the action of the manual control member.

Owing to the timepiece according to the invention, the release of the striking mechanism can be manually controlled by employing the click used for automatic release, which reduces the number of parts used in the striking mechanism and which reduces the size of the striking mechanism.

According to another feature of the invention, the pivoting axis of the toggle lever is arranged at a free end of the release lever, on the side opposite the pivoting axis of the release lever. The toggle lever extends the release lever on the side opposite the pivoting axis of the release lever. Thus, the release lever with the toggle lever can be made in a generally similar shape to that of a conventional rigid release lever, and the kinematics of the striking mechanism in automatic release mode can be identical to the kinematics of a conventional rigid release lever.

Preferably, the click comprises a detent finger whose free end meshes with the teeth of the detent wheel and an actuating arm which cooperates with the manual control member such that the manual control member causes the toggle lever to pivot towards the detent wheel while abutting against the actuating arm. A particularly simple manual control mechanism is thus obtained.

Advantageously, the toggle lever comprises a stop member that abuts against an associated axial surface arranged in the release lever in order to connect the toggle lever as it pivots to the release lever. This type of connection between the toggle lever and the release lever is particularly simple to accomplish.

According to an advantageous embodiment, the striking mechanism comprises a winding cam which cooperates with an associated shoulder of the release lever in order to control the winding of the release lever against a spring, and in that the release lever is restrained in its wound position by a locking device, and the release lever releases the striking mechanism by unlocking the locking device. The winding cam has the shape of a rotating snail of increasing radius comprising a step between the portion with the smallest radius and the portion with the largest radius. In the wound position, the shoulder of the release lever abuts against the portion of the winding cam with the largest radius and the locking device locks the winding arm in rotation. This embodiment has the advantage of minimising the energy taken from the motion work of the timepiece movement. The winding force of the release lever is produced by the rotation of the winding cam. The release lever is pre-wound prior to release of the striking mechanism such that the winding cam only has to act on the locking device in order to release the striking mechanism.

BRIEF DESCRIPTION OF THE DRAWINGS

Other features and advantages of the present invention will appear more clearly upon reading the following detailed description, made with reference to the annexed drawings, given by way of non-limiting example and in which.

DETAILED DESCRIPTION OF THE ILLUSTRATIVE EMBODIMENTS

Figure 1:
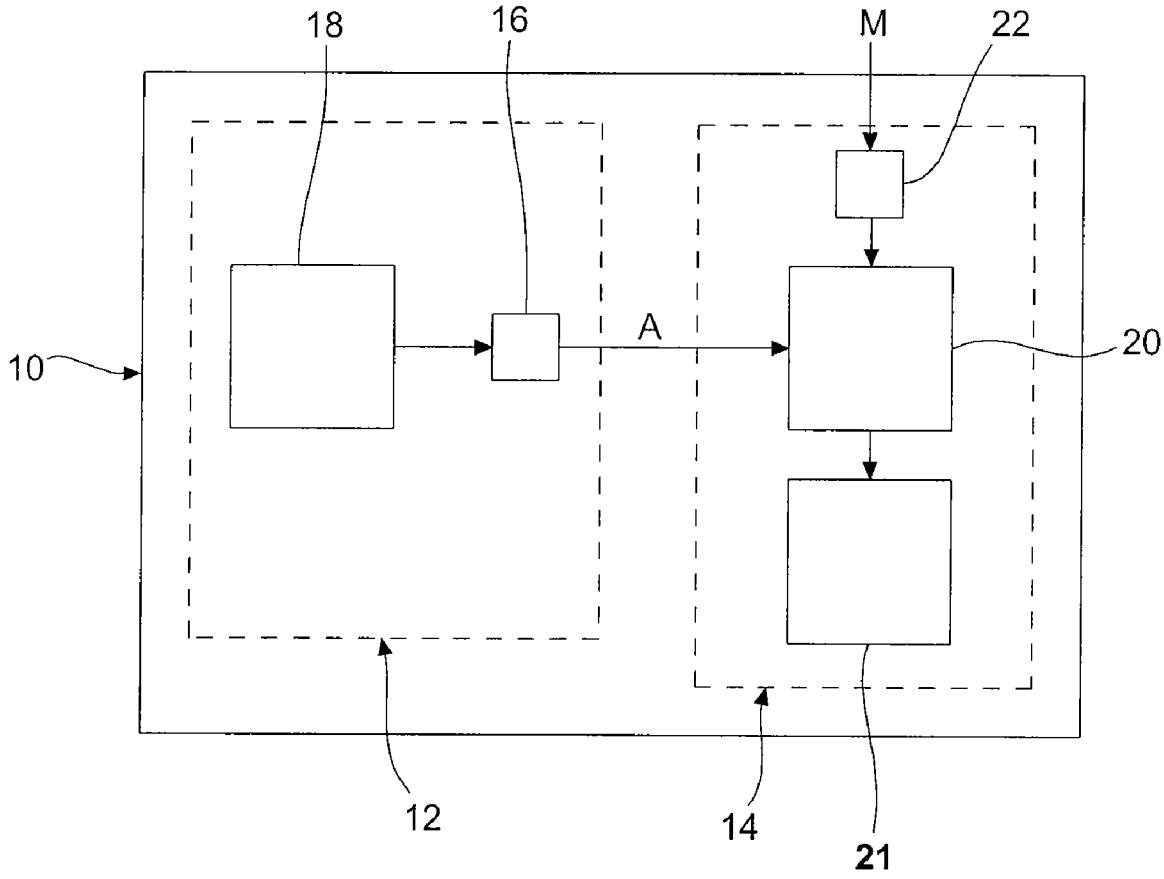
FIG. 1 is a diagram that shows the main elements of the repeater timepiece according to the invention.

FIG. 1 shows a timepiece 10 made in accordance with the teaching of the invention in the form of a flow chart. The timepiece 10 is preferably a watch which comprises a mechanical watch movement 12 allowing watch 10 to display the current time, for example by means of hands, and which comprises a repeater striking mechanism for indicating at least the current time via hammers striking gongs (not shown).

In a known manner, watch 10 comprises a case (not shown) containing at least one plate (not shown) on which the watch movement 12 and the striking mechanism 14 are mounted.

According to the embodiment shown, the repeater striking mechanism 14 of watch 10 according to the invention is of the grand strike type, i.e. it is capable of striking the hours and the quarters, either by automatic release A, or by release upon request via the effect of a manual intervention M. Automatic release A is obtained by means of a release cam 16, which is driven in rotation by the motion work 18 of the watch movement 12 and which mechanically activates a release member 20 so as to release the strike train 21 fitted to striking mechanism 14. Release upon request is obtained by means of a member 22 with manual control M which mechanically activates the release member 20.

Figure 2:
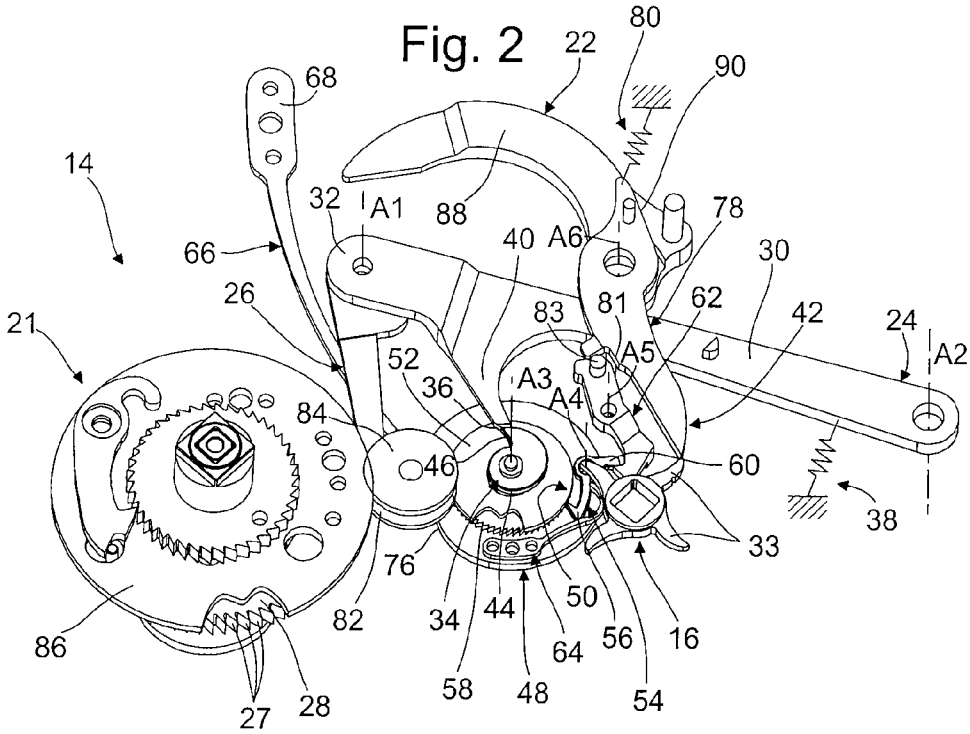
FIG. 2 is a perspective view that shows schematically the main elements of the striking mechanism of the timepiece of FIG. 1 in an initial state just prior to release.
Figure 3:
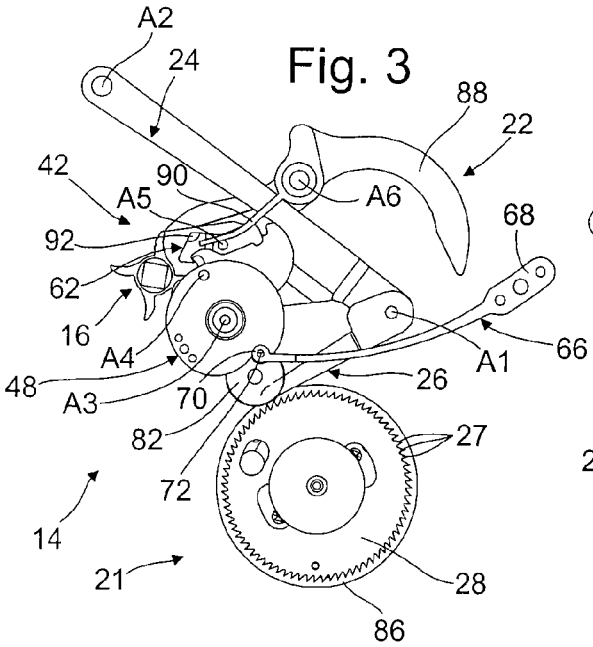
FIG. 3 is a bottom view that shows schematically the striking mechanism of FIG. 2 in its initial state just prior to release.
Figure 4:
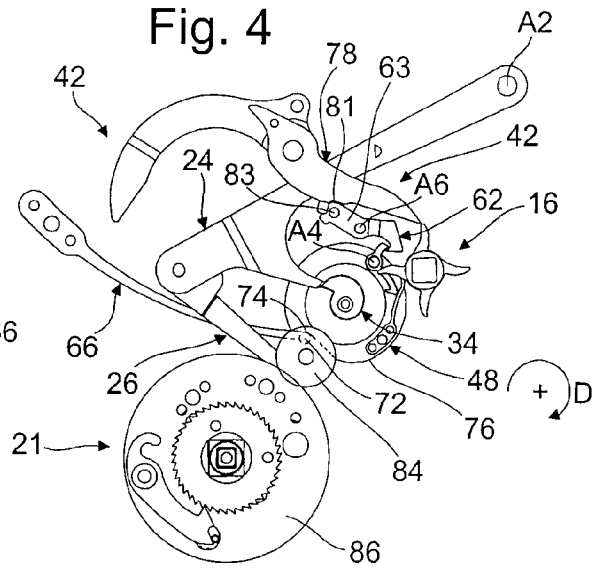
FIG. 4 is a top view that shows schematically the striking mechanism of FIG. 2 in it is initial state just prior to release.

We will now described, with reference to FIG. 2 and thereafter, the elements of striking mechanism 14 that are essential for comprehension of the invention. FIGS. 2 to 4 show striking mechanism 14 in an initial state just prior to release of the striking mechanism.

For a more complete description of the structure and operation of a grand strike mechanism, reference can be made to the chapter dedicated to this type of mechanism in the work by François Lecoultre entitled, "Les montres compliquées" (ISBN 2-88175-1), incorporated herein by reference.

Striking mechanism 14 comprises a release lever 24 fitted with a click 26 which is pivotably mounted about an axis A1 on release lever 24 and which is fitted with a detent finger 25, the free end of which will mesh with the teeth 27 of a ratchet detent wheel 28. Release lever 24 comprises here a main, overall rectangular body 30, which is pivotably mounted, at one end thereof, about a release axis A2 and which carries, at its free end 32, on the opposite side to release axis A2, click 26.

The tipping of release lever 24 can be automatically controlled by the rotation of release cam 16. Release cam 16 has the shape here of a star 33 with four arms which allow a strike to be release every quarter of an hour. Release cam 16 is secured in rotation on the arbour carrying the centre wheel of motion work 18 via a square connection, so as to complete one revolution per hour.

In accordance with the teaching of the invention, striking mechanism 14 comprises a winding cam 34 which cooperates with an associated shoulder 36 of release lever 24 to control the winding of release lever 24 against a return spring 38. Return spring 38 stresses release lever 24 resiliently towards detent wheel 28, i.e. in the direction that click 26 meshes with detent wheel 28.

According to the embodiment shown here, shoulder 36 of release lever 24 is arranged at the free end of a winding arm 40, which extends generally transversely from main body 30 of release lever 24.

According to other features of the invention, release lever 24 is held in its wound position by a locking device 42, and release cam 16 releases the striking mechanism by unlocking locking device 42.

Advantageously, winding cam 34 is rotatably mounted about a winding axis A3 and it has the shape of a snail of increasing radius when it rotates in the direction D of release of the striking mechanism, i.e. in the clockwise direction looking at FIG. 4. The external peripheral edge 44 of winding cam 34 thus forms a control surface, which cooperates via contact with shoulder 36 of release lever 24 so as to push release lever 24 back against the return force of spring 38, when winding cam 34 rotates in the release direction D. The external peripheral edge 44 of winding cam 34 comprises a step 46, between the portion thereof with the smallest radius and the portion thereof with the largest radius, enabling release lever 24 to drop during release. In the wound position, shoulder 36 of release lever 34 and locking device 42 locks winding cam 34 in rotation.

Winding cam 34 is secured in rotation here to a plate 48 that is driven in rotation, about winding axis A3, by strike train 21, when the striking mechanism is released. For this purpose, plate 48 is fitted with a retractable hooking device 50, which, in the hooked position, connects plate 48 in rotation to an intermediate wheel 52 that is driven in rotation by strike train 21, when the striking mechanism is released.

Hooking device 50 is formed here by a lever 54, which is pivotably mounted about an axis A4 on plate 48. Lever 54 comprises, on one hand, a driving hook 56, which hooks onto a ratchet wheel 58, arranged under intermediate wheel 52, secured in rotation to intermediate wheel 52 and, on the other hand, a locking arm 60, which cooperates with a locking hook 62 belonging to locking device 42, in order to restrain winding cam 34 in rotation and in order to control driving hook 56 in the retracted position. Driving hook 56 is drawn towards its hooked position by a hooking spring 64 in the form of a resilient arm which is secured to plate 48.

The locking hook 62 is pivotably mounted about an axis A5. It comprises a control arm 63, which extends on the opposite side to the hooking portion relative to axis A5. Locking hook 62 is made to pivot towards its locked position, in which it restrains locking arm 60, by a return spring (not shown).

Preferably, plate 48 is drawn in rotation in the direction of release by a plate spring 66, so as to initiate the rotational movement of winding cam 34 when the striking mechanism is released, as will be seen hereinafter. The plate spring 66 is formed here by a resilient arm which comprises a fixed end 68 and a free end 70 provided with a roller 72 which is free to rotate and which abuts in a notch 74 provided for this purpose in the external peripheral edge 76 of plate 48. Advantageously, the external peripheral edge 76 of plate 48 is snail-shaped, with an increasing radius in the direction of release D, defining notch 74 for abutment by plate spring 66.

The external peripheral edge 76 forms a rolling path for roller 72. Roller 72 can be made of synthetic ruby to minimise friction with external peripheral edge 76.

According to an advantageous embodiment, locking device 42 comprises an uncoupling lever 78 which is wound, against a return spring 80, by the release cam 16 and which causes locking hook 62 to pivot towards its unlocked position when release cam 16 releases uncoupling lever 78.

Uncoupling lever 78 comprises a support surface 81 which is arranged opposite a pin 83 disposed on control arm 63 of locking hook 62 such that, when uncoupling lever 78 is released by release cam 16, the support surface 81 abuts against pin 83 to cause locking hook 62 to pivot towards its unlocked position.

According to the embodiment shown, intermediate wheel 52 is connected in rotation to strike train 21 by means of two intermediate wheels 82, 84 which are coaxial and which are superposed axially. The bottom intermediate wheel 82 meshes with intermediate wheel 52 and the top intermediate wheel 84 meshes with a drive wheel 86 belonging to strike train 21. Drive wheel 86 is coaxial here with detent wheel 28.

Advantageously, manual control member 22 cooperates with locking device 42 in order to release the striking mechanism manually. For this purpose, manual control member 22 comprises an actuating lever 88, here in the shape of a "croissant", which extends on one side from its pivoting axis A5. Actuating lever 88 is extended, on the other side of pivoting axis A5, via an unlocking finger 90, visible in FIG. 3, which passes under uncoupling lever 78, and which is provided for cooperating with a stud 92 arranged, on one face of locking hook 62, in order to control hook 62 in the unlocked position.

Manual control member 22 is for example actuated by a push button (not shown) accessible from the outside of the case of watch 10. When it is actuated, actuating lever 88 pivots in the anti-clockwise direction looking at FIG. 3, in the clockwise direction looking at FIG. 4, such that unlocking finger 90 abuts against stud 92 and causes unlocking hook 62 to pivot towards its unlocked position, against its spring.

We will now describe the operation of striking mechanism 14 according to the invention, particularly with reference to FIGS. 4 to 7, which show several successive positions occupied by the elements of striking mechanism 14.

FIG. 4 shows striking mechanism 14 in its initial state, just prior to automatic release.

In this initial state, one of arms 33 of release cam 16 is still in contact, via its free end, with uncoupling lever 78 which is wound against its return spring 80. Release lever 24 is also wound against its return spring 38, its shoulder 36 abutting against the portion of winding cam 34 with the largest radius. Winding cam 34 is blocked in rotation with plate 46 via locking hook 62, which restrains locking arm 60.

It should be noted that locking arm 60 is held abutting against locking hook 62 via plate spring 66, which draws plate 48 in the direction of release D.

By restraining locking arm 60, locking hook 62 controls drive hook 56 in the retracted position, against hooking spring 64, such that ratchet wheel 58 is free to rotate in relation to plate 48.

Figure 5:
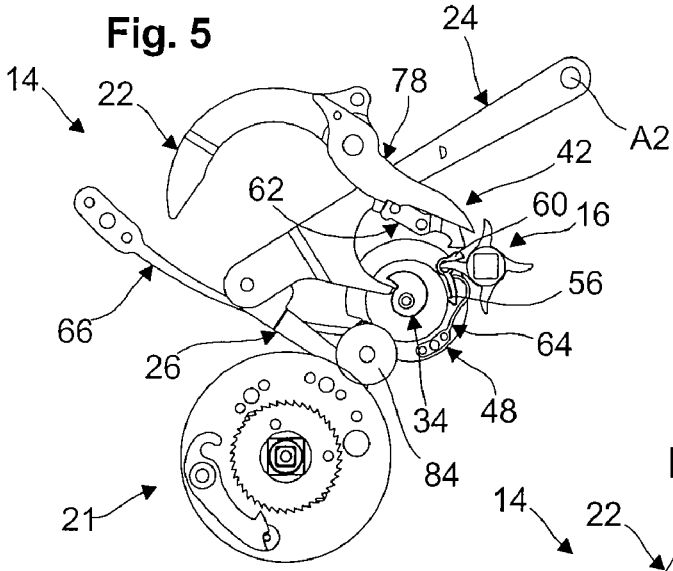
FIGS. 5 and 6 are similar views to those of FIG. 4, which show the striking mechanism of FIG. 2 in two successive intermediate states just after release.

FIG. 5 shows striking mechanism 14 in a first intermediate state, just after automatic release. In this intermediate state, release cam 16 has continued its rotation in the clockwise direction, by several degrees relative to the initial state, thus releasing uncoupling lever 78.

The release of uncoupling lever 78 causes it to return to a stable position of equilibrium, via the action of its return spring 80. Before reaching its stable position of equilibrium, uncoupling lever 78 passes this stable position of equilibrium such that it activates locking hook 62 in its unlocking direction, pressing on pin 83, which releases locking lever 60. Locking hook 62 then returns to its locking position via the action of its return spring.

The release of locking lever 60 immediately causes plate 48 to pivot in the direction of release D, via the action of plate spring 66. As winding cam 34 rotates with plate 48, step 46 shifts angularly in the direction of release D, enabling shoulder 36 of release lever 24 to fall back onto the portion of winding cam 34 with the smallest radius, as shown in FIG. 5.

As it falls, release lever 34 pivots towards detent wheel 28, such that click 26 meshes with the teeth of detent wheel 28 causing it to rotate. The rotation of detent wheel 28 then releases strike train 21, which, in a conventional manner, will take the hour, minute and quarter information to the corresponding snails and activate the hammers on the gongs accordingly.

As it rotates about its axis, detent wheel 28 causes the rotation of drive wheel 86, which transmits this rotational movement to intermediate wheel 52 via intermediate wheels 82, 84.

In parallel, the release of locking lever 60 causes lever 54 to pivot about its axis A4, via the action of hooking spring 64, such that drive hook 56 engages in the teeth of ratchet wheel 58. Because of drive hook 56, plate 48 and winding cam 34 are thus linked in rotation with ratchet wheel 58 and intermediate wheel 52. The rotation of intermediate wheel 52 thus causes the rotation of winding cam 34, which cooperates with shoulder 36 to wind release lever 24 for the next release of the striking mechanism.

Figure 6:
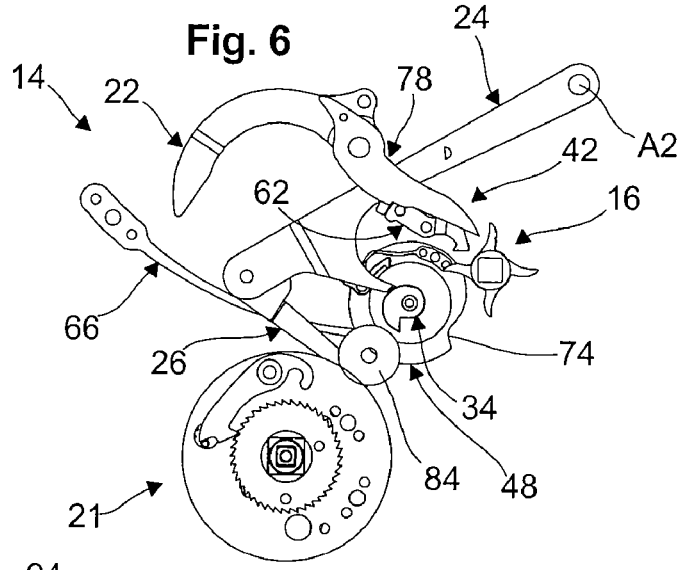

FIG. 6 shows striking mechanism 14 in a second intermediate state after release. In this intermediate state, release lever 24 is in the process of being wound, winding cam 34 not having completed one revolution yet.

Figure 7:
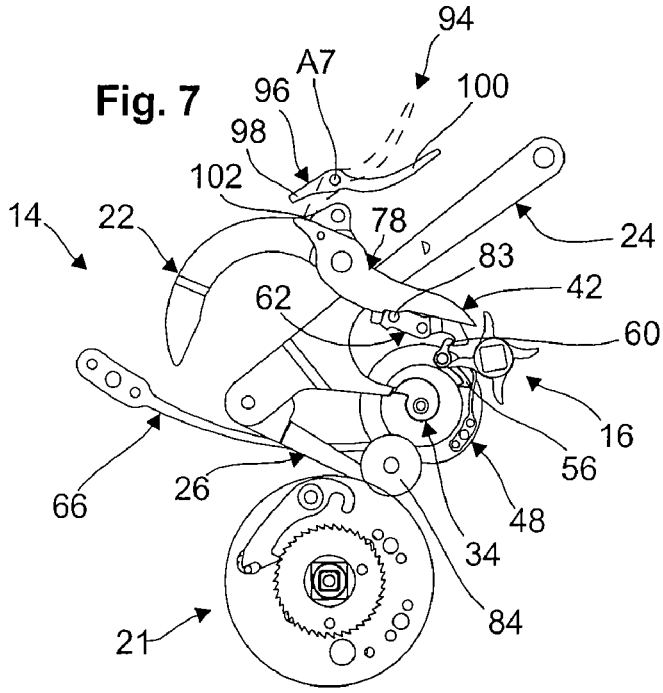
FIG. 7 is a similar view to that of FIG. 4 which shows the striking mechanism of FIG. 2 in a final state after release.

Winding cam 34 continues to rotate in direction of release D until locking lever 60 is stopped by locking hook 62, which occurs in FIG. 7, where striking mechanism 14 is shown in a final state. Locking lever 60 then occupies its initial angular position again, in relation to winding axis A3, which corresponds to the wound state of release lever 24. Release lever 24 is then ready for another release.

By stopping locking lever 60, locking hook 62 causes lever 54 to pivot about its axis A4, in the anti-clockwise direction here, such that drive hook 56 is released from ratchet wheel 58. this allows plate 48 to be detached from intermediate wheel 52, to enable intermediate wheel 52 to continue to rotate freely with strike train 21.

It will be noted that, during the rotation of plate 48, roller 72 carried by plate spring 66 rollers over the external peripheral edge 76 of plate 48 until it returns to its initial position in notch 74.

Manual release operates in a similar way to the manner previously described. Activation of manual control member 22 causes unlocking hook 62 to be unlocked, which releases locking lever 60 and releases the striking mechanism.

It should be noted that, in striking mechanism 14 according to the invention, the force taken from watch movement 12 during automatic release is minimal since release cam 16 only has to overcome the effort of return spring 80 of uncoupling lever 78. The effort necessary to wind release lever 24 is taken here from strike train 21, since it is the rotation of drive wheel 86 which enables winding cam 34 to complete one revolution. Previously, it was necessary to obtain a force of approximately twelve to fourteen grams where the arm of the release cam abuts the release lever. With the invention, only two to three grams are needed where arm 33 of release cam 16 abuts uncoupling lever 78.

According to a variant (not shown), uncoupling lever 78 could be omitted. Release cam 16 could then directly control the pivoting of locking hook 62.

The use of uncoupling lever 78 has the advantage of compensating for certain dispersions in the positioning of the rotating parts relative to each other, in particular as regards the centring of release cam 16 and locking hook 62 on their respective axes.

One of the advantages of the timepiece according to the invention is that it benefits from an almost instantaneous release of the striking mechanism since the release lever is pre-wound.

Advantageously, striking mechanism 14 according to the invention comprises a silence mechanism 94, which is shown in FIG. 7, and which neutralises the automatic release of the striking mechanism. This silence mechanism 94 comprises a silence lever 96 pivoting about an axis A7 between a neutral angular position and a locking angular position, which is shown in dotted lines in FIG. 7.

Silence lever 96 comprises, on either side of its pivoting axis A7, a locking finger 98 and an activating finger 100. It may be activated by a push-button (not shown) accessible from outside the case of watch 10 and acting on activating finger 100.

When silence lever 96 is operated in the locking position, locking finger 98 abuts against a corresponding surface 102 of uncoupling lever 78 so as to limit the shake thereof. More specifically, locking finger 98 prevents uncoupling lever from pivoting beyond its position of equilibrium, when it is released by release cam 16, which prevents uncoupling lever 78 from abutting against pin 83 to unlock locking hook 62.

One advantage of this silence mechanism 94 is that it can be activated at any time, including during or just after release of the striking mechanism. In fact, since silence mechanism 94 simply limits the travel of uncoupling lever 78, without blocking the pivoting thereof, the latter continues to be wound upon the passage of each arm 33 of release cam 16 without its general operation being altered by passage into silent mode.

FIGS. 8 to 11 show an embodiment of the mechanism allowing manual control in accordance with the invention. According to this embodiment, release lever 24 is fitted with a toggle lever 104 which carries click 26.

Toggle lever 104 has the shape here of a connecting rod which is pivotably mounted on a top transverse face 106 of release lever 24 about an auxiliary pivoting axis A8. Auxiliary axis A8 is arranged at the free end 32 of release lever 24. Toggle lever 104 extends in a rectilinear manner in the extension of main body 30 of release lever 24, on the opposite side to pivoting axis A2 of release lever 24.

Click 26 is pivotably mounted about its axis A1 at the free end 108 of toggle lever 104, on the opposite side to auxiliary axis A8.

Figure 11:
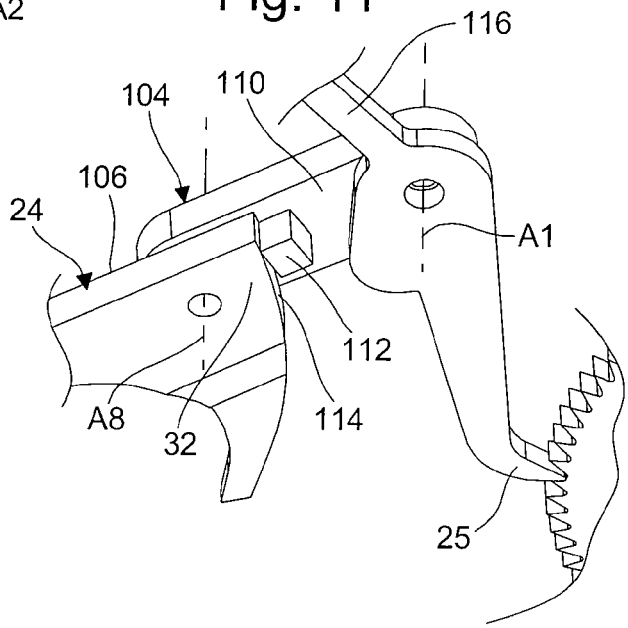
FIG. 11 is a detailed perspective view which shows the bottom of the toggle lever and its stop member for connection with the release lever of the striking mechanism.

For its pivoting connection with release lever 24, toggle lever 104 comprises, on its bottom face 110, opposite the top transverse face 106 of release lever 24, a stop member 112, which abuts against an associated axial surface 114 arranged in the free end 32 of release lever 24, as shown in FIG. 11.

Figure 8:
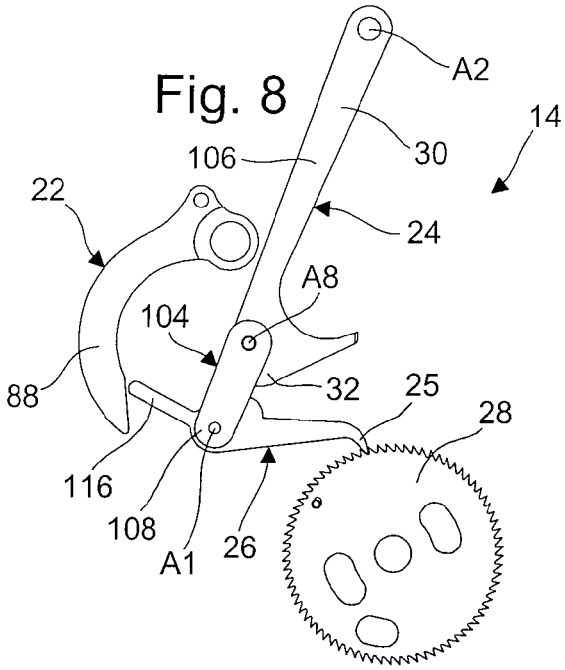
FIG. 8 is a top view that shows schematically a variant of the striking mechanism according to the invention in which the click which meshes with the detent wheel is carried by a ball and socket joint.

Preferably, there is a spring (not shown), which draws toggle lever 104 to pivot about auxiliary axis A8 in the direction of abutment of stop member 112 against release lever 24, i.e. in the clockwise direction looking at FIG. 8.

According to an advantageous embodiment, click 26 comprises, on the opposite side to detent finger 25 in relation to axis A1, an actuating arm 116, which is activated by manual control member 22.

FIG. 8 shows striking mechanism 14 in an initial state, prior to release.

Figure 10:
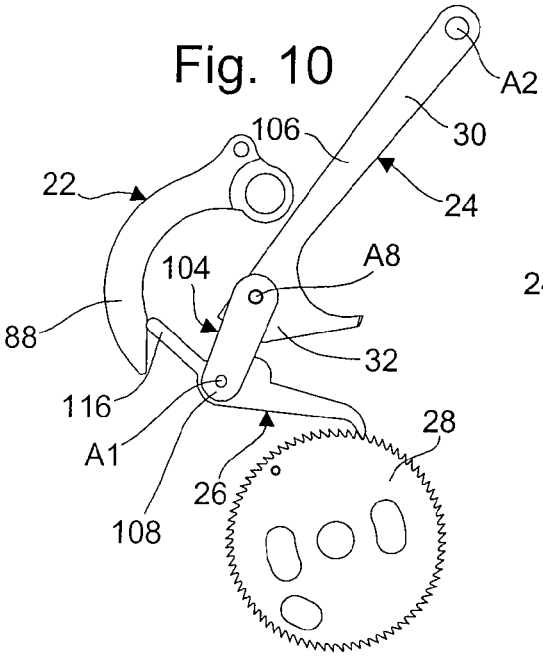
FIG. 10 is a similar view to that of FIG. 8, which shows the variant during manual release.

During manual release, illustrated in FIG. 10, activating lever 88 of manual control member 22 abuts against the free end of activating arm 116, which causes the ball and socket joint, which is pivoting about its auxiliary axis A8, to bend relative to release lever 24, to allow click 26 to drive detent wheel 28 in rotation. Release lever 24 thus remains in its initial wound position.

When the pressure on activating lever 88 is released, toggle lever 104 pivots about auxiliary axis A8 in the direction of return to its initial state, illustrated in FIG. 8. The pivoting of toggle lever 104 is stopped by stop member 112 which abuts against release lever 24.

Figure 9:
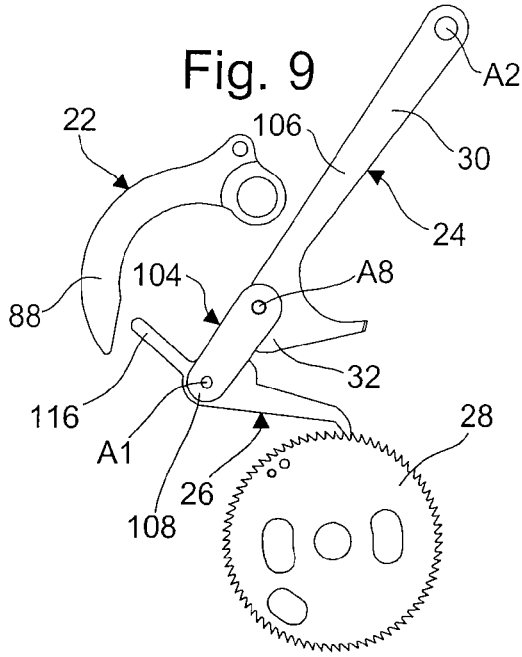
FIG. 9 is a similar view to that of FIG. 8, which shows the variant during automatic release.

During automatic release, illustrated in FIG. 9, release lever 24 pivots about its axis A2 towards detent wheel 28 with toggle lever 104. Since stop member 112 is abutting against the associated axial surface 114, toggle lever 104 is pivoted with release lever 24, such that click 26 meshes with detent wheel 28 as previously.

It should be noted that this embodiment can be implemented in any striking mechanism 14, including a striking mechanism like that described in the aforementioned prior art. The advantage is that it enables a single click 26 to be used for automatic release and for manual release, whereas previously striking mechanisms had to be fitted with a first click controlled by the release lever for automatic release and a second click controlled by the manual control member for manual release.

What is claimed is:

1. A timepiece including a timepiece movement and a repeater striking mechanism, the striking mechanism being released either automatically by the timepiece movement, or manually by a manual control member, wherein the striking mechanism includes a release lever fitted with a click which is pivotably mounted on the release lever and which meshes with the teeth of a ratchet detent wheel such that, during automatic release, a release cam driven by a motion work of the timepiece movement causes the release lever to pivot towards the detent wheel and the click drives the detent wheel in rotation, wherein the release lever is fitted with a toggle lever which carries the click, wherein the toggle lever is pivotably connected to the release lever during automatic release, and wherein manual release is caused by the pivoting of the toggle lever relative to the release lever via the action of the manual control member.

2. The timepiece according to claim 1, wherein the pivoting axis of the toggle lever is arranged at a free end of the release lever, on the side opposite the pivoting axis of the release lever.

3. The timepiece according to claim 1, wherein the toggle lever extends the release lever, on the side opposite the pivoting axis of the release lever.

4. The timepiece according to claim 1, wherein the click includes a detent finger whose free end meshes with the teeth of the detent wheel and an actuating arm which cooperates with the manual control member such that the manual control member causes the toggle lever to pivot towards the detent wheel by abutting against the actuating arm.

5. The timepiece according to claim 1, wherein the toggle lever comprises a stop member which abuts against an associated axial surface arranged in the release lever in order to pivotably connect the toggle lever to the release lever.

6. The timepiece according to claim 1, wherein the striking mechanism includes a winding cam which cooperates with an associated shoulder of the release lever to control the winding of the release lever against a spring, wherein the release lever is restrained in the wound position by a locking device, and wherein the winding cam releases the striking mechanism by unlocking the locking device.

7. The timepiece according to claim 6, wherein the winding cam has the shape of a rotating snail of increasing radius including a step between the portion with the smallest radius and the portion with the largest radius.

8. The timepiece according to claim 7, wherein, in the wound position, the shoulder of the release lever abuts against the portion of the winding cam with the largest radius and the locking device locks the winding cam in rotation.

* * * * *